US010677200B2

(12) United States Patent
Andrzejewski et al.

(10) Patent No.: US 10,677,200 B2
(45) Date of Patent: Jun. 9, 2020

(54) HYDROCARBON EMISSION CONTROL SYSTEM

(71) Applicant: GM GLOBAL TECHNOLOGY OPERATIONS LLC, Detroit, MI (US)

(72) Inventors: Jason M. Andrzejewski, Washington, MI (US); Timothy E. McCarthy, Grand Blanc, MI (US)

(73) Assignee: GM GLOBAL Technology Operations LLC, Detroit, MI (US)

( * ) Notice: Subject to any disclaimer, the term of this patent is extended or adjusted under 35 U.S.C. 154(b) by 0 days.

(21) Appl. No.: 16/144,049

(22) Filed: Sep. 27, 2018

(65) Prior Publication Data

US 2020/0102899 A1 Apr. 2, 2020

(51) Int. Cl.
*F02D 41/00* (2006.01)
*F02M 25/08* (2006.01)

(52) U.S. Cl.
CPC ..... *F02M 25/089* (2013.01); *F02D 41/0032* (2013.01); *F02M 25/0809* (2013.01); *F02M 25/0836* (2013.01); *F02M 25/0854* (2013.01); *F02M 25/0872* (2013.01); *F02M 2025/0845* (2013.01)

(58) Field of Classification Search
CPC ..... F02M 2025/0845; F02M 25/0872; F02M 25/089
See application file for complete search history.

(56) References Cited

U.S. PATENT DOCUMENTS 3,352,294 A * 11/1967 Skarstrom ..... F02M 25/08 123/519
5,056,494 A * 10/1991 Kayanuma ..... F02M 25/0872 123/516
5,111,795 A * 5/1992 Thompson ..... F02M 25/0872 123/519
5,165,379 A * 11/1992 Thompson ..... B60K 15/03504 123/516
5,456,237 A * 10/1995 Yamazaki ..... F02M 25/0854 123/519
5,477,836 A * 12/1995 Hyodo ..... F02M 25/0854 123/519
6,526,950 B2 * 3/2003 Ito ..... F02M 25/089 123/518
8,118,009 B2 * 2/2012 Pursifull ..... F02B 43/10 123/406.31
8,191,536 B2 * 6/2012 Devries ..... F02M 25/089 123/198 F (Continued)

*Primary Examiner* — Kevin R Steckbauer
(74) *Attorney, Agent, or Firm* — Quinn IP Law

(57) ABSTRACT

An exemplary system for monitoring and controlling evaporative emissions for a vehicle includes a first fuel vapor adsorption canister, a second fuel vapor adsorption canister, a first passage from the fuel supply to the first canister, a second passage from the first canister to the canister, the second passage including a first valve selectively actuatable from a first position to a second position, a third passage from the first and second canisters for venting the first and second canisters, a fourth passage connecting the second canister to the third passage, and a controller electrically connected to the first valve. Fuel vapor is routed to the first canister when a first condition is not satisfied and fuel vapor is routed to the second canister when the first condition is satisfied.

16 Claims, 3 Drawing Sheets

(56) References Cited

U.S. PATENT DOCUMENTS

| | | | | |
|---|---|---|---|---|
| 8,273,164 | B2 * | 9/2012 | Makino | B01D 53/0415 123/519 |
| 8,312,867 | B2 * | 11/2012 | Pursifull | F02B 43/10 123/516 |
| 8,459,238 | B2 * | 6/2013 | Pursifull | F02B 43/10 123/516 |
| 8,814,987 | B2 * | 8/2014 | Tschantz | B60K 15/03504 95/146 |
| 9,732,685 | B2 * | 8/2017 | Dudar | B60K 15/03504 |
| 2009/0007890 | A1 * | 1/2009 | Devries | F02M 25/0836 123/520 |
| 2009/0157277 | A1 * | 6/2009 | Pursifull | F02B 43/10 701/102 |
| 2011/0011264 | A1 * | 1/2011 | Makino | B01D 53/0415 96/6 |
| 2012/0152211 | A1 * | 6/2012 | Pursifull | F02B 43/10 123/520 |
| 2012/0204720 | A1 * | 8/2012 | Tschantz | B60K 15/03504 95/148 |
| 2013/0014731 | A1 * | 1/2013 | Pursifull | F02B 43/10 123/525 |
| 2017/0130659 | A1 * | 5/2017 | Dudar | B60K 15/03504 |

* cited by examiner

HYDROCARBON EMISSION CONTROL SYSTEM

INTRODUCTION

The present invention relates generally to the field of vehicles and, more specifically, to the management of hydrocarbons within an evaporative emissions system.

In conventional gasoline-powered engines, fuel tank vapor (typically comprising lower molecular weight hydrocarbons) is vented to a canister containing high surface area carbon granules for temporary absorption of fuel tank vapor emissions. Later, during engine operation, ambient air is drawn through the carbon granule bed to purge absorbed fuel vapor from the surfaces of the carbon particles and carry the removed fuel vapor into the air induction system of the vehicle engine. However, some hydrocarbons may not be absorbed by the carbon granules of the canister and may escape to the ambient environment via a canister fresh air vent line.

SUMMARY

Embodiments according to the present disclosure provide a number of advantages. For example, embodiments according to the present disclosure enable . . . .

In one aspect, a system for monitoring and controlling evaporative emissions for a vehicle includes a first fuel vapor adsorption canister, a second fuel vapor adsorption canister, a first passage from the fuel supply to the first fuel vapor adsorption canister, a second passage from the first fuel vapor adsorption canister to the second fuel vapor adsorption canister, the second passage including a first valve selectively actuatable from a first position to a second position, a third passage from the first and second fuel vapor adsorption canisters for venting the first and second fuel vapor adsorption canisters, a fourth passage connecting the second fuel vapor adsorption canister to the third passage, and a controller electrically connected to the first valve. Fuel vapor is routed to the first fuel vapor adsorption canister when a first condition is not satisfied and fuel vapor is routed to the second fuel vapor adsorption canister when the first condition is satisfied.

In some aspects, the first condition is a diurnal soak time of greater than three days.

In some aspects, the controller actuates the first valve from the first position to the second position when the first condition is satisfied and actuates the first valve from the second position to the first position when the first condition is not satisfied.

In some aspects, the first position of the first valve blocks fuel vapor from entering the second fuel vapor adsorption canister and the second position of the first valve permits fuel vapor to enter the second fuel vapor adsorption canister.

In some aspects, the system further includes an evaporative leak check pump fluidicly coupled to the first and second fuel vapor adsorption canisters and electrically coupled to the controller, the evaporative leak check pump configured to generate a vacuum condition in each of the first and second fuel vapor adsorption canisters such that the controller can determine an existence of a leak within the system.

In some aspects, the system further includes a second valve fluidicly coupled to the second fuel vapor adsorption canister and electrically connected to the controller, the second valve allowing flow through the fourth passage in a first position and selectively actuatable by the controller to a second position to restrict flow through the fourth passage such that the controller can determine an existence of a leak within the system.

In some aspects, the first valve is a two-way, switching, or latching valve.

In another aspect, an automotive vehicle includes an engine, a fuel supply coupled to the engine such that a fluid travels between the fuel supply to the engine, and an evaporative emissions control system. The evaporative emissions control system includes a first fuel vapor adsorption canister, a second fuel vapor adsorption canister, a first passage from the fuel supply to the first fuel vapor adsorption canister, a second passage from the first fuel vapor adsorption canister to the second fuel vapor adsorption canister, the second passage including a first valve selectively actuatable from a first position to a second position, a third passage from the first and second fuel vapor adsorption canisters for venting the first and second fuel vapor adsorption canisters, a fourth passage connecting the second fuel vapor adsorption canister to the third passage, and a controller electrically connected to the first valve. Fuel vapor is routed to the first fuel vapor adsorption canister when a first condition is not satisfied and fuel vapor is routed to the second fuel vapor adsorption canister when the first condition is satisfied.

In some aspects, the first condition is a diurnal soak time of greater than three days.

In some aspects, the controller actuates the first valve from the first position to the second position when the first condition is satisfied and actuates the first valve from the second position to the first position when the first condition is not satisfied.

In some aspects, the first position of the first valve blocks fuel vapor from entering the second fuel vapor adsorption canister and the second position of the first valve permits fuel vapor to enter the second fuel vapor adsorption canister.

In some aspects, the evaporative emissions control system further includes an evaporative leak check pump fluidicly coupled to the first and second fuel vapor adsorption canisters and electrically coupled to the controller, the evaporative leak check pump configured to generate a vacuum condition in each of the first and second fuel vapor adsorption canisters such that the controller can determine an existence of a leak within the system.

In some aspects, the evaporative emissions control system further includes a second valve fluidicly coupled to the second fuel vapor adsorption canister and electrically connected to the controller, the second valve allowing flow through the fourth passage in a first position and selectively actuatable by the controller to a second position to restrict flow through the fourth passage such that the controller can determine an existence of a leak within the system.

In some aspects, the first valve is a two-way, switching, or latching valve and the second valve is a canister vent solenoid valve.

In yet another aspect, a method for controlling an evaporative emissions control system of a vehicle includes the steps of providing an evaporative emissions control system including a first fuel vapor adsorption canister, a second fuel vapor adsorption canister, a valve fluidicly coupled to the first and second fuel vapor adsorption canisters and selectively actuatable from a first position to a second position, a solenoid valve fluidicly coupled to the second fuel vapor adsorption canister, and a controller electronically connected to the valve and to the solenoid valve, determining whether a first condition is satisfied, actuating the valve to the first position when the first condition is satisfied, actuating the valve to the second position when the first condition is not satisfied, and determining a purge level of both of the first fuel vapor adsorption canister and the second fuel vapor adsorption canister and, if the purge level is equal to or below a predetermined level, actuating the valve to the first position.

In some aspects, the evaporative emissions control system further includes an evaporative leak check pump fluidicly coupled to the first and second fuel vapor adsorption canisters and electrically connected to the controller and the method further includes generating a vacuum condition in the first and second fuel vapor adsorption canisters with the evaporative leak check pump and determining an existence of a leak within the evaporative emissions control system.

BRIEF DESCRIPTION OF THE DRAWINGS

The present disclosure will be described in conjunction with the following figures, wherein like numerals denote like elements.

Figure 1:
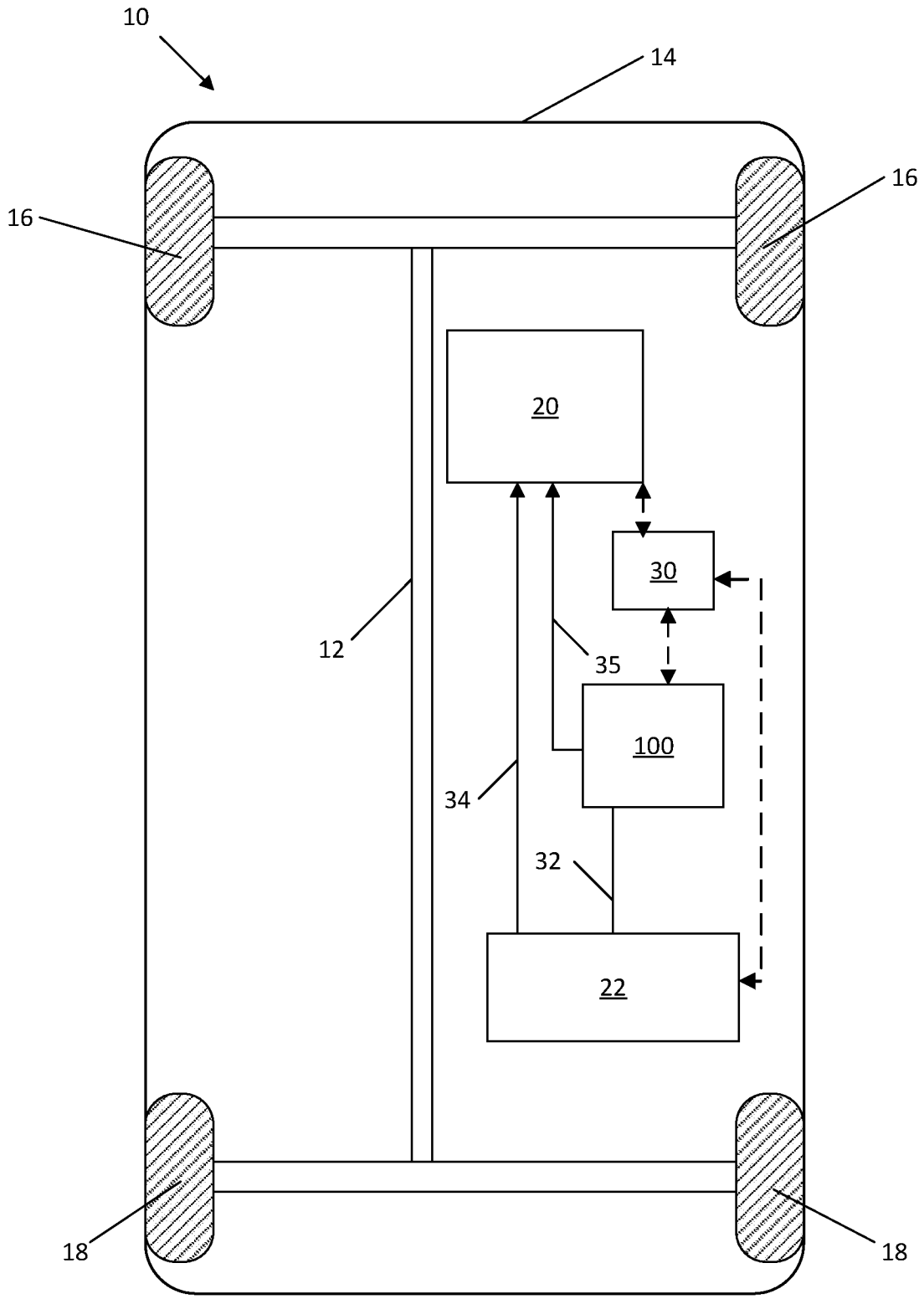
FIG. 1 is a schematic diagram of a vehicle having a hydrocarbon emission control system, according to an embodiment.

The foregoing and other features of the present disclosure will become more fully apparent from the following description and appended claims, taken in conjunction with the accompanying drawings. Understanding that these drawings depict only several embodiments in accordance with the disclosure and are not to be considered limiting of its scope, the disclosure will be described with additional specificity and detail through the use of the accompanying drawings. Any dimensions disclosed in the drawings or elsewhere herein are for the purpose of illustration only.

DETAILED DESCRIPTION

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the present invention. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Certain terminology may be used in the following description for the purpose of reference only, and thus are not intended to be limiting. For example, terms such as "above" and "below" refer to directions in the drawings to which reference is made. Terms such as "front," "back," "Left," "right," "rear," and "side" describe the orientation and/or location of portions of the components or elements within a consistent but arbitrary frame of reference which is made clear by reference to the text and the associated drawings describing the components or elements under discussion. Moreover, terms such as "first," "second," "third," and so on may be used to describe separate components. Such terminology may include the words specifically mentioned above, derivatives thereof, and words of similar import.

Fuel evaporative emission control systems have been in use on gasoline engine-driven automotive vehicles for many years. The fuel typically consists of a hydrocarbon mixture. During daytime heating, fuel temperature increases. The vapor pressure of the heated gasoline increases and fuel vapor will flow from any opening in the fuel tank. Normally, to minimize or prevent vapor loss to the atmosphere, the tank is vented through a conduit to a canister which contains suitable fuel adsorbent material. The fuel in a vehicle's tank and fuel lines is subject to evaporation over time, and in particular fuel evaporation may be due to temperature cycling resulting from daily heating and cooling, known as diurnal cycling.

However, some hydrocarbons may not be trapped by the adsorbent material in the canister and may travel through a fresh air line connected to the canister. Specifically, for three-day diurnal emission testing, selective routing of fuel vapor to multiple canisters, as discussed below, may be used to control and reduce hydrocarbon emissions.

In some embodiments, as discussed herein, flow of fuel vapor to a second canister is controlled by a switching valve to reduce hydrocarbon emissions that may result from temperature cycling beyond a three-day diurnal period. The embodiments discussed herein use a single canister vent solenoid valve along with the vehicle processing system to monitor hydrocarbon emissions and system compliance.

As shown, the vehicle 10 generally includes an engine 20, a fuel supply 22, and an evaporative emissions control system 100 including, in some embodiments, a first fuel vapor adsorption canister, a second fuel vapor adsorption canister, and a valve connecting the first and second fuel vapor adsorption canisters, as discussed in greater detail herein. The vehicle 10 also includes a controller 30 that is connected via a wired or wireless connection to the engine 20, the fuel supply 22, and/or one or more components of the evaporative emissions control system 100. In some embodiments, the controller 30 is a vehicle processing system configured to monitor the performance of the evaporative emissions control system 100.

Figure 2:
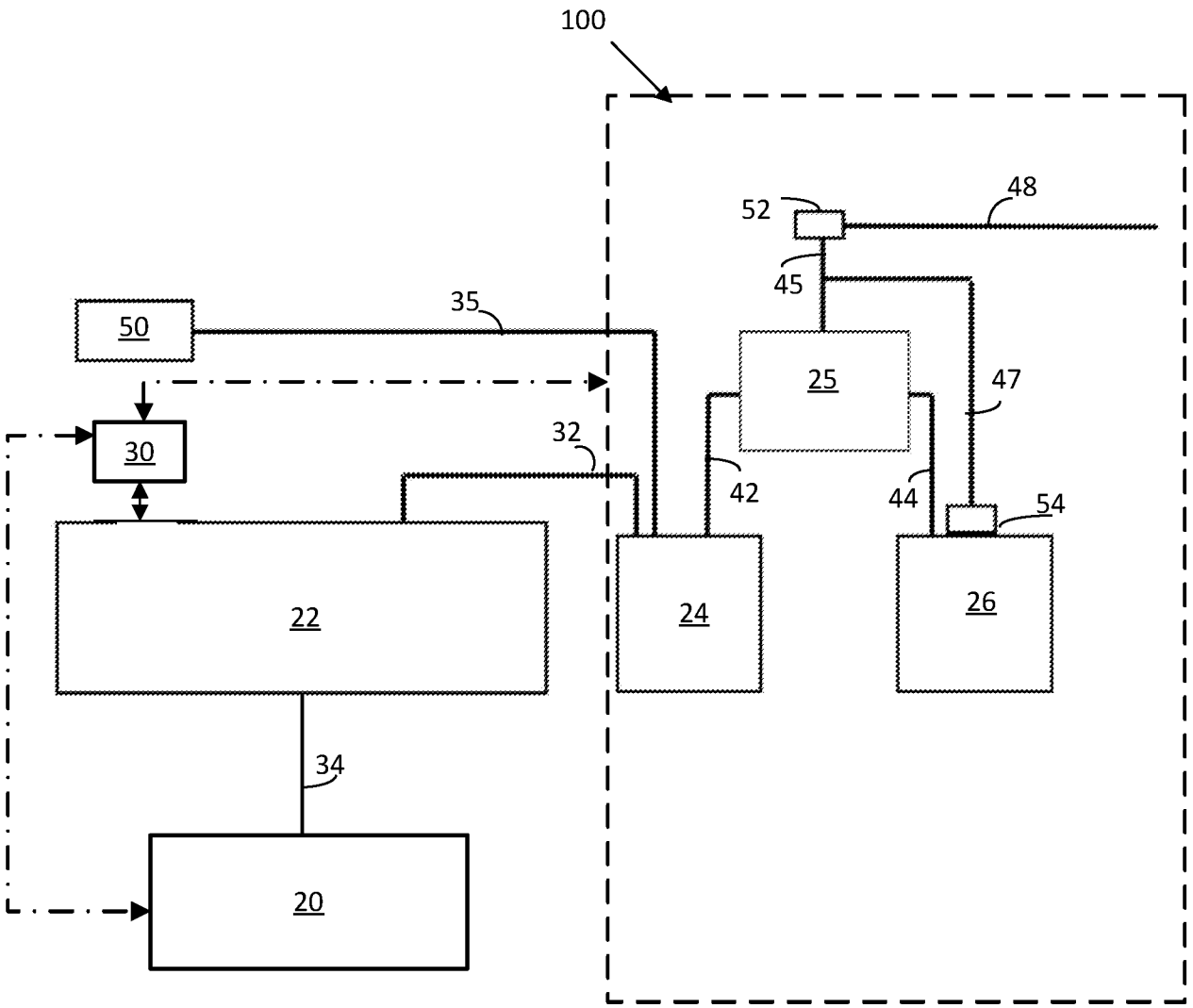
FIG. 2 is a schematic cross-sectional diagram of a hydrocarbon emission control system, according to an embodiment.

With reference to FIGS. 1 and 2, in some embodiments, the engine 20 is an internal combustion engine configured to burn a hydrocarbon-based fuel such as gasoline. The fuel supply 22 is, in some embodiments, a fuel tank configured to store and deliver the hydrocarbon-based fuel to the engine 20 via a fuel line 34. A fuel supply vent line 32 connects the fuel supply 22 with the first vapor canister 24 of the evaporative emissions control system 100. When temperatures rise due to diurnal heating, or when refueling the vehicle, fuel vapor flows from the fuel supply 22 via the vent line 32 to the first fuel vapor adsorption canister 24 where the adsorbent material of the first fuel vapor adsorption canister 24 traps many of the hydrocarbons of the fuel vapor.

However, temperature cycling due to diurnal heating may result in some hydrocarbons breaking through the fuel vapor adsorption canister 24 and flowing through a fresh air vent line 48 toward the ambient atmosphere. To trap these breakthrough hydrocarbons, the system 100 includes a second fuel vapor adsorption canister 26 coupled to the first fuel vapor adsorption canister 24 via a valve 25, to capture the breakthrough hydrocarbons to minimize or prevent hydrocarbon emissions.

In some embodiments, the first fuel vapor adsorption canister 24 is comprised of multiple chambers of activated carbon, scrubbers/hydrocarbon adsorbers (HCA)/honeycombs, or a combination of the above such that there is a low pressure drop across all chambers. In some embodiments, the second fuel vapor adsorption canister 26 is an extended soak canister (ESC). In some embodiments, the second fuel vapor adsorption canister 26 is comprised of multiple chambers of activated carbon, scrubbers/hydrocarbon adsorbers (HCA)/honeycombs, or a combination of activated carbon and scrubbers/HCA/honeycombs with the final assembly yielding a low pressure drop across all chambers.

As shown in FIG. 2, in one embodiment, a purge line 35 fluidicly connects the first vapor adsorption canister 24 to a purge outlet 50. A first fuel vapor line 42 and a second fuel vapor line 44 fluidicly connect the first fuel vapor adsorption canister 24 to the second fuel vapor adsorption canister 26 via the valve 25. A first vent line 45 is connected to the valve 25 and fluidicly connects the first and second vapor adsorption canisters 24, 26 to an evaporative leak check pump (ELCP) 52. In some embodiments, a second vent line 47 connects the second vapor adsorption canister 26 to the first vent line 45 via a second valve 54, while bypassing the valve 25. In some embodiments, the second valve 54 is a canister vent solenoid valve (CVS). Ambient fresh air is drawn into the system 100 via the fresh air vent line 48. In some embodiments, a controller, such as the controller 30, is wired or wirelessly connected to one or both of the ELCP 52 and the CVS 54.

In some embodiments, the valve 25 is a two-way, switching, or latching valve. The valve 25 is selectively actuatable by, for example and without limitation, the controller 30, from a first position to a second position and vice versa.

In some embodiments, the first fuel vapor adsorption canister 24 is a primary canister that is vented directly to the fresh air vent line 48 if the diurnal cycling is a three-day soak or less. In the first position, the valve 25 is open to fresh air via the fresh air vent line 48 and closed to the second fuel vapor adsorption canister 26 such that fuel vapors do not enter the second fuel vapor adsorption canister 26.

For extended soaks or diurnal cycles (longer than three days), the valve 25 is actuated to the second position by a controller, such as the controller 30, to direct vapor bleeding and purging of the first fuel vapor adsorption canister 24. In the second position, the valve 25 routes fuel vapor through the second fuel vapor adsorption canister 26. Additionally, in the second position, the valve 25 blocks a direct path of the fuel vapor from the first fuel vapor adsorption canister 24 to the fresh air vent line 48. When the valve 25 is in the second position, the normally-open CVS 54 allows venting of the second fuel vapor canister 26, along with the first fuel vapor canister 24, to the ambient environment via the first and second vent lines 45, 47 and the fresh air vent line 48.

In some embodiments, extended drive time may be needed to purge both canisters 24, 26. In some embodiments, extended drive time over multiple drive cycles/diurnals may be needed to ensure both canisters 24, 26 have been sufficiently purged before actuating the valve 25 to the first position and routing fuel vapor to the first fuel vapor adsorption canister 24. In some embodiments, calibration is used to determine the number of days of an extended soak, and thus to determine when to actuate the valve 25 from the from first position to the second position and vice versa. In some embodiments, the controller 30 may determine that a cumulative purge after an extended soak is needed and estimate the impact of additional diurnal cycle(s) if needed.

In some embodiments, the controller 30 can perform diagnostics and check for small/large fuel vapor leaks from the evaporative emissions control system 100 using, for example and without limitation, the ELCP 52. In some embodiments, the ELCP 52 generates a vacuum condition in one or both of the first and second fuel vapor adsorption canisters 24, 26 to check the valve 25 for leakage to atmosphere when the valve 25 is in the second, or extended soak, position. The controller 30 will close the CVS 54 and pull vacuum with the ELCP 52. In some embodiments, a leak is detected, either by the ELCP 52 or the controller 30, or by any other detection means (such as, for example and without limitation, one or more sensors connected to the system 100).

Figure 3:
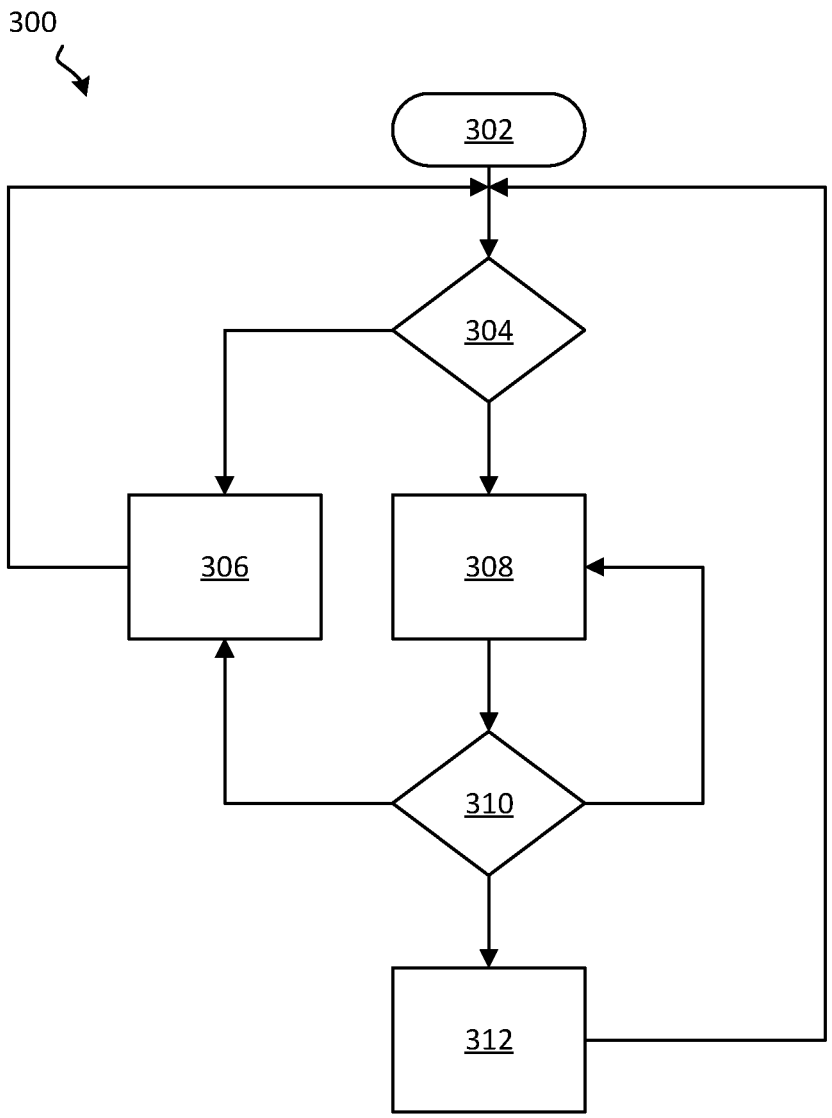
FIG. 3 is a flow diagram of a method of controlling a hydrocarbon emission control system, according to an embodiment.

FIG. 3 illustrates an exemplary method 300 to control an evaporative emissions control system of a vehicle. The method 300 can be utilized in connection with the vehicle 10 and the system 100 discussed herein. The method 300 can be utilized in connection with the controller 30 as discussed herein, or by other systems associated with or separate from the vehicle, in accordance with exemplary embodiments. The order of operation of the method 300 is not limited to the sequential execution as illustrated in FIG. 3, but may be performed in one or more varying orders, or steps may be performed simultaneously, as applicable in accordance with the present disclosure.

The method 300 begins at 302 and proceeds to 304. At 304, the controller determines whether a first condition is satisfied, that is, whether a diurnal soak period of the vehicle 10 is greater than three days. If the first condition is not satisfied, the method 300 proceeds to 306 and the controller 30 actuates the valve 25 to the first position to allow the flow of fuel vapor to the first vapor adsorption canister 24 while restricting flow of fuel vapor to the second vapor adsorption canister 26.

If the first condition is satisfied, that is, the diurnal soak period of the vehicle 10 is equal to or greater than three days, the method 300 proceeds to 308. At 308, the controller 30 actuates the valve 25 to the second position to allow the flow of fuel vapor to the second vapor adsorption canister 26 while restricting a direct path of the fuel vapor from the first fuel vapor adsorption canister 24 to the fresh air vent line 48.

From 306, the method 300 returns to 304 and proceeds as discussed herein. From 308, the method 300 proceeds to 310, wherein the controller 30 determines whether both canisters 24, 26 have been sufficiently purged before actuating the valve 25 to the first position and routing fuel vapor to the first fuel vapor adsorption canister 24. If the controller 30 determines that both canisters 24, 26 have been purged to a level at or below a predetermined level, the method 300 returns to 306 and proceeds as discussed herein. Otherwise, the method 300 proceeds to 312 and the system continues to purge both of the canisters 24, 26. From 312, the method 300 returns to 304 and proceeds as discussed herein.

In some embodiments, the method further includes determining whether a leak is present in the system 100 by, for example and without limitation, actuating the ELCP 52 via a controller, such as the controller 30, to generate a vacuum condition in one or both of the first and second canisters 24, 26.

It should be emphasized that many variations and modifications may be made to the herein-described embodiments, the elements of which are to be understood as being among other acceptable examples. All such modifications and variations are intended to be included herein within the scope of this disclosure and protected by the following claims. Moreover, any of the steps described herein can be performed simultaneously or in an order different from the steps as ordered herein. Moreover, as should be apparent, the features and attributes of the specific embodiments disclosed herein may be combined in different ways to form additional embodiments, all of which fall within the scope of the present disclosure.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

Moreover, the following terminology may have been used herein. The singular forms "a" "an," and "the" include plural referents unless the context dearly dictates otherwise. Thus, for example, reference to an item includes reference to one or more items. The term "ones" refers to one, two, or more, and generally applies to the selection of some or all of a quantity. The term "plurality" refers to two or more of an item. The term "about" or "approximately" means that quantities, dimensions, sizes, formulations, parameters, shapes and other characteristics need not be exact, but may be approximated and/or larger or smaller, as desired, reflecting acceptable tolerances, conversion factors, rounding off, measurement error and the like and other factors known to those of skill in the art. The term. "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

Numerical data may be expressed or presented herein in a range format. It is to be understood that such a range format is used merely for convenience and brevity and thus should be interpreted flexibly, to include not only the numerical values explicitly recited as the limits of the range, but also interpreted to include all of the individual numerical values or sub-ranges encompassed within that range as if each numerical value and sub-range is explicitly recited. As an illustration, a numerical range of "about 1 to 5" should be interpreted to include not only the explicitly recited values of about 1 to about 5, but should also be interpreted to also include individual values and sub-ranges within the indicated range. Thus, included in this numerical range are individual values such as 2, 3 and 4 and sub-ranges such as "about 1 to about 3," "about 2 to about 4" and "about 3 to about 5," "1 to 3," "2 to 4," "3 to 5," etc. This same principle applies to ranges reciting only one numerical value (e.g., "greater than about 1") and should apply regardless of the breadth of the range or the characteristics being described. A plurality of items may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. Furthermore, where the terms "and" and "or" are used in conjunction with a list of items, they are to be interpreted broadly, in that any one or more of the listed items may be used alone or in combination with other listed items. The term "alternatively" refers to selection of one of two or more alternatives, and is not intended to limit the selection to only those listed alternatives or to only one of the listed alternatives at a time, unless the context clearly indicates otherwise.

The processes, methods, or algorithms disclosed herein can be deliverable to/implemented by a processing device, controller, or computer, which can include any existing programmable electronic control unit or dedicated electronic control unit. Similarly, the processes, methods, or algorithms can be stored as data and instructions executable by a controller or computer in many forms including, but not limited to, information permanently stored on non-writable storage media such as ROM devices and information alterably stored on writeable storage media such as floppy disks, magnetic tapes, CDs, RAM devices, and other magnetic and optical media. The processes, methods, or algorithms can also be implemented in a software executable object. Alternatively, the processes, methods, or algorithms can be embodied in whole or in part using suitable hardware components, such as Application Specific Integrated Circuits (ASICs), Field-Programmable Gate Arrays (FPGAs), state machines, controllers or other hardware components or devices, or a combination of hardware, software and firmware components. Such example devices may be on-board as part of a vehicle computing system or be located off-board and conduct remote communication with devices on one or more vehicles.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further exemplary aspects of the present disclosure that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, embodiments described as less desirable than other embodiments or prior art implementations with respect to one or more characteristics are not outside the scope of the disclosure and can be desirable for particular applications.

What is claimed is:

1. A system for monitoring and controlling evaporative emissions for a vehicle, the system comprising:

a first fuel vapor adsorption canister; a second fuel vapor adsorption canister;

a first passage from a fuel supply to the first fuel vapor adsorption canister which does not comprise a valve, permitting an unregulated flow of fuel vapor to the first fuel vapor adsorption canister;

a second passage from the first fuel vapor adsorption canister to the second fuel vapor adsorption canister, the second passage comprising a first valve selectively actuatable from a first position to a second position;

a third passage directly connected to the first valve and allowing a passage of fuel vapor from both the first and second fuel vapor adsorption canisters via the first valve, the third passage venting the first and second fuel vapor adsorption canisters;

a fourth passage connecting the second fuel vapor adsorption canister to the third passage; and a controller electrically connected to the first valve;

wherein fuel vapor is routed to the first fuel vapor adsorption canister when a first condition is not satisfied and fuel vapor is routed to the second fuel vapor adsorption canister when the first condition is satisfied.

2. The system of claim 1, wherein the first condition is a diurnal soak time of greater than three days.

3. The system of claim 1 wherein the controller actuates the first valve from the first position to the second position when the first condition is satisfied and actuates the first valve from the second position to the first position when the first condition is not satisfied.

4. The system of claim 1, wherein the first position of the first valve blocks fuel vapor from entering the second fuel vapor adsorption canister and the second position of the first valve permits fuel vapor to enter the second fuel vapor adsorption canister.

5. The system of claim 1 further comprising an evaporative leak check pump fluidicly coupled to the first and second fuel vapor adsorption canisters and electrically coupled to the controller, the evaporative leak check pump configured to generate a vacuum condition in each of the first and second fuel vapor adsorption canisters such that the controller can determine an existence of a leak within the system.

6. The system of claim 1 further comprising a second valve fluidicly coupled to the second fuel vapor adsorption canister and electrically connected to the controller, the second valve allowing flow through the fourth passage in a first position and selectively actuatable by the controller to a second position to restrict flow through the fourth passage such that the controller can determine an existence of a leak within the system.

7. The system of claim 1, wherein the first valve is a two-way, switching, or latching valve.

8. An automotive vehicle, comprising:

an engine;

a fuel supply coupled to the engine such that a fluid travels from the fuel supply to the engine; and an evaporative emissions control system comprising a first fuel vapor adsorption canister;

a second fuel vapor adsorption canister;

a first passage from the fuel supply to the first fuel vapor adsorption canister which does not comprise a valve, permitting an unregulated flow of fuel vapor to the first fuel vapor adsorption canister;

a second passage from the first fuel vapor adsorption canister to the second fuel vapor adsorption canister, the second passage comprising a first valve selectively actuatable from a first position to a second position;

a third passage directly connected to the first valve and allowing a passage of fuel vapor from both the first and second fuel vapor adsorption canisters via the first valve, the third passage venting the first and second fuel vapor adsorption canisters;

a fourth passage connecting the second fuel vapor adsorption canister to the third passage; and a controller electrically connected to the first valve;

wherein fuel vapor is routed to the first fuel vapor adsorption canister when a first condition is not satisfied and fuel vapor is routed to the second fuel vapor adsorption canister when the first condition is satisfied.

9. The automotive vehicle of claim 8, wherein the first condition is a diurnal soak time of greater than three days.

10. The automotive vehicle of claim 8, wherein the controller actuates the first valve from the first position to the second position when the first condition is satisfied and actuates the first valve from the second position to the first position when the first condition is not satisfied.

11. The automotive vehicle of claim 8, wherein the first position of the first valve blocks fuel vapor from entering the second fuel vapor adsorption canister and the second position of the first valve permits fuel vapor to enter the second fuel vapor adsorption canister.

12. The automotive vehicle of claim 8, wherein the evaporative emissions control system further comprises an evaporative leak check pump fluidicly coupled to the first and second fuel vapor adsorption canisters and electrically coupled to the controller, the evaporative leak check pump configured to generate a vacuum condition in each of the first and second fuel vapor adsorption canisters such that the controller can determine an existence of a leak within the system.

13. The automotive vehicle of claim 8 further comprising a second valve fluidicly coupled to the second fuel vapor adsorption canister and electrically connected to the controller, the second valve allowing flow through the fourth passage in a first position and selectively actuatable by the controller to a second position to restrict flow through the fourth passage such that the controller can determine an existence of a leak within the system.

14. The automotive vehicle of claim 13, wherein the first valve is a two-way, switching, or latching valve and the second valve is a canister vent solenoid.

15. A method for controlling an evaporative emissions control system of a vehicle, the method comprising:

providing an evaporative emissions control system comprising a first fuel vapor adsorption canister directly fluidicly connected to a fuel vapor source, a second fuel vapor adsorption canister, a valve fluidicly coupled to the first and second fuel vapor adsorption canisters and selectively actuatable from a first position to a second position, the valve permitting flow to only the first fuel vapor adsorption canister in the first position and both the first and second fuel vapor adsorption canisters in the second position, a vent passage directly connected to the valve and allowing a passage of fuel vapor from both the first and second fuel vapor adsorption canisters via the valve to vent the first and second fuel vapor adsorption canisters, a solenoid valve fluidicly coupled to the second fuel vapor adsorption canister, and a controller electronically connected to the valve and to the solenoid;

determining whether a first condition is satisfied;

actuating the valve to the first position when the first condition is not satisfied;

actuating the valve to the second position when the first condition is satisfied; and determining that a purge of both of the first fuel vapor adsorption canister and the second fuel vapor adsorption canister is not needed and, actuating the valve to the first position to allow a flow of fuel vapor to only the first fuel vapor adsorption canister in response to determining that the purge is not needed.

16. The method of claim 15, wherein the evaporative emissions control system further comprises an evaporative leak check pump fluidicly coupled to the first and second fuel vapor adsorption canisters and electrically connected to the controller and the method further comprises generating a vacuum condition in the first and second fuel vapor adsorption canisters with the evaporative leak check pump and determining an existence of a leak within the evaporative emissions control system.

* * * * *